United States Patent [19]

Magat et al.

[11] Patent Number: 4,529,011

[45] Date of Patent: Jul. 16, 1985

[54] SYSTEMS WITH ORIENTABLE HOOKS

[75] Inventors: Henri Magat, Caluire; Pierre Mouterde, Chatillon sur Chalaronne, both of France

[73] Assignee: Societe Staubli-Verdol, Chassieu, France

[21] Appl. No.: 515,088

[22] Filed: Jul. 18, 1983

[30] Foreign Application Priority Data

Jul. 19, 1982 [FR] France ..... 82 12847

[51] Int. Cl.[3] ..... D03C 3/06; D03C 3/40; D03C 3/38

[52] U.S. Cl. ..... 139/65; 139/85; 139/86

[58] Field of Search ..... 139/65, 59, 60, 61, 139/85, 86

[56] References Cited

U.S. PATENT DOCUMENTS

| | | | |
|---|---|---|---|
| 510,752 | 12/1893 | Woodhead | 139/85 |
| 3,747,647 | 7/1973 | Bergmann | 139/59 |
| 3,835,895 | 9/1974 | Bassi | 139/65 |
| 4,418,725 | 12/1983 | Mouterde et al. | 139/59 |

FOREIGN PATENT DOCUMENTS

| | | | |
|---|---|---|---|
| 2315968 | 10/1974 | Fed. Rep. of Germany | 139/85 |
| 2455035 | 5/1975 | Fed. Rep. of Germany | 139/65 |
| 2746094 | 4/1979 | Fed. Rep. of Germany | 139/85 |
| 3103729 | 8/1982 | Fed. Rep. of Germany | 139/65 |
| 2509333 | 1/1983 | France | 139/65 |
| 411288 | 6/1934 | United Kingdom | 139/86 |

*Primary Examiner*—James Kee Chi

*Attorney, Agent, or Firm*—Dowell & Dowell

[57] ABSTRACT

In a weaving system in which the selection of the hooks is effected by rotation of their shanks so as to present their nose elements to the blades of the gripper frames or, on the contrary, to retract them, each hook comprises at its end a flat eyelet which, when it returns into its low rest position, engages in a depression with elliptic inlet in a bottom board and which tends to return it to the correct angular orientation corresponding to this position. In addition, to each eyelet is attached an elastic blade which passes through a slit in a guiding board and which acts in the manner of a return torsion spring to complete the effect of the depression.

3 Claims, 7 Drawing Figures

SYSTEMS WITH ORIENTABLE HOOKS

The present invention relates to double-lift weaving systems in which the hooks taken by one of the two frames of grippers which move vertically in opposite direction to one another, are shifted angularly about the axis of their shank so as to escape the other frame without having to extend, for this purpose, the duration of what is called the press, i.e. the phase during which said hooks are selectively pushed by the corresponding needles.

This type of system, of which it may be said that it incorporates orientable hooks, was described in French application No. 72 13495 of Apr. 11, 1972 which is now corresponding to U.S. Pat. No. 3,835,895. Thanks to the reduction of the press time, it has proved that it can operate at cadences clearly higher than those of conventional systems. However, experience has shown that, with looms operating at very high speed, there were sometimes faults in selection. Thanks to a thorough study of the behaviour of the hooks on such looms, it has been determined that these faults result from a defective orientation thereof on the blades of the retaining frame. These blades should normally cause the nose elements that they support to be oriented exactly in vertical planes perpendicular thereto. However, slight momentary angular deviations are sometimes noted which, on the looms of the type in question, may attain values such that the selective lift of the hooks is affected thereby.

It is an object of the invention to overcome this drawback.

According to the invention, the retaining of the hooks in the low rest position is assured no longer by a frame cooperating with retaining nose elements, but with the aid of a fixed bottom board provided for each hook with a depression having a flared inlet at the bottom of which the lower end of the shank of the hook, shaped as an eyelet or the like, is centered in a precise angular position with respect to the axis of the hook shank.

According to another characteristic of the invention, this means for orienting the hook in question is completed by interposing between the lower end thereof and the corresponding heddle an elastic leaf which furthermore slides in a rectangular slot in a fixed guiding board provided beneath the above-mentioned bottom board. In this way, this leaf provides torque which tends constantly to return the hook to the rest orientation desired. Its elasticity allows rotations through 45° of the shank about its axis without opposing a detrimental resistance thereto, but it provides a return torque which prevents or limits any exaggerated rotation and contributes to returning the hook to its rest orientation.

The accompanying drawing, given by way of example, will enable the invention, the characteristics that it presents and the advantages that it may procure, to be more readily understood.

Figure 1:
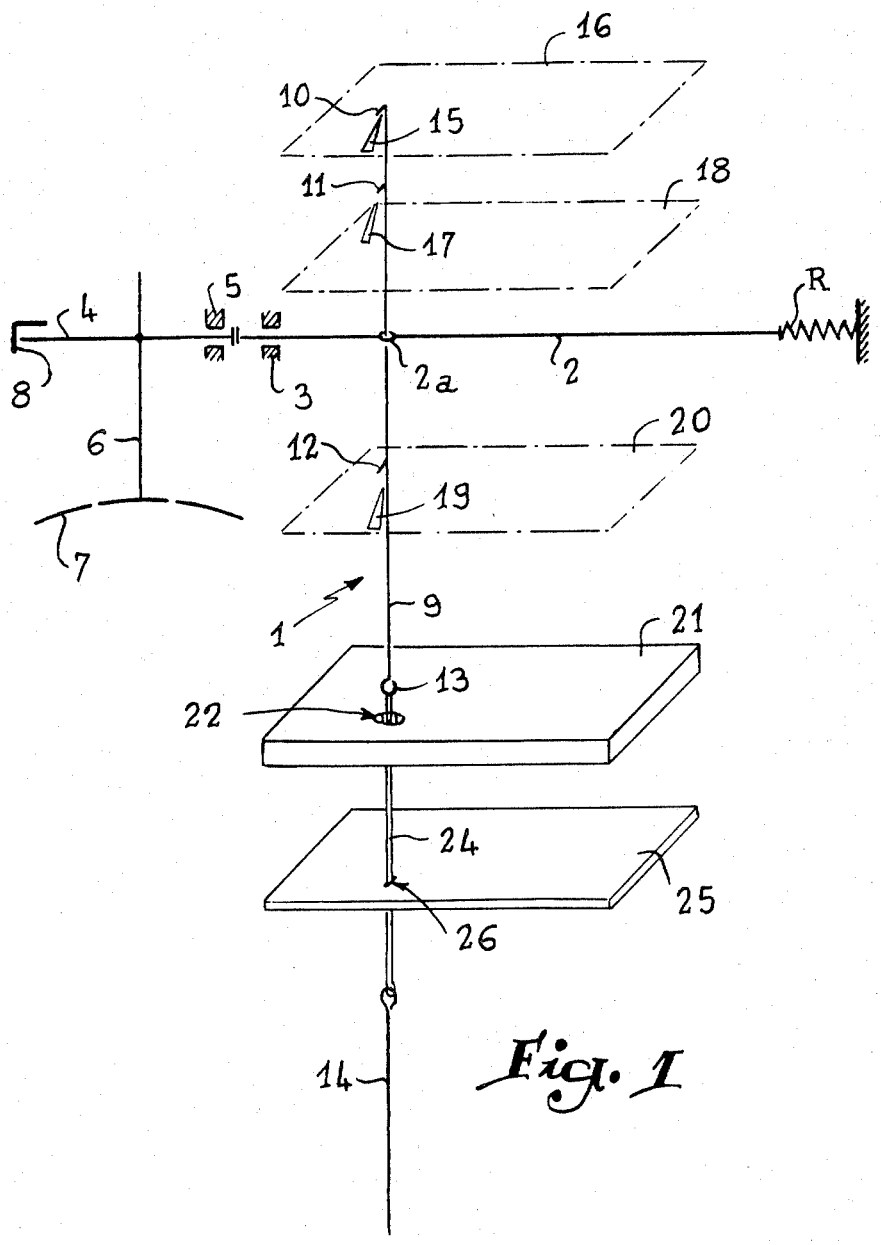
FIG. 1 is a schematic view of a system according to the invention, only one of the hooks thereof being shown.

FIG. 1 schematically shows a system applying the present invention. It comprises single shank hooks of which only one has been shown at 1. Each of them is controlled for selection by a needle 2 comprising a loop 2*a* which surrounds its shank. The needles 2 traverse a plate 3 and receive the selection action of tappets 4 guided by another perforated plate 5. With each needle 2 is associated a small needle 6, which is adapted to cooperate with the perforated paper 7 of the system. When a small needle 6 encounters solid paper, it is raised and the tappet 4 thus comes into contact with a stop 8 which oscillates horizontally, needle 2 is then pushed against the reaction of a spring R, taking along the hook 1 in question.

In the case of a hole felt by the small needle, the tappet 4 escapes the action of the stop 8 so that the hook is not pushed by needle 2.

Figure 2:
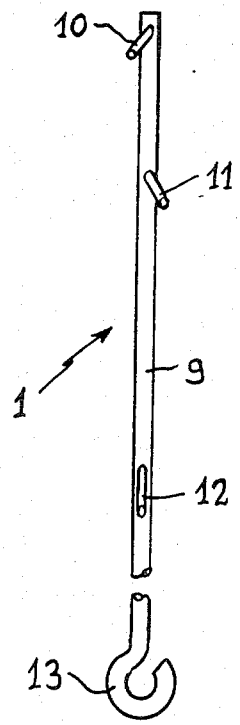
FIG. 2 is a view in elevation of this hook.
Figure 3:
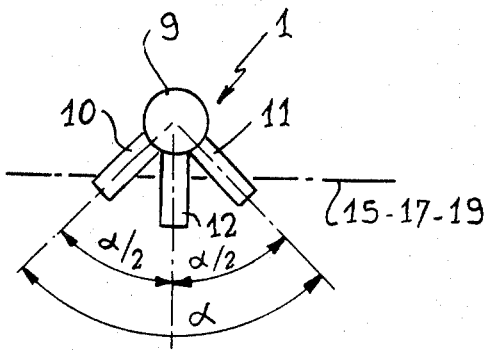
FIG. 3 is a plan view thereof.
Figure 4:
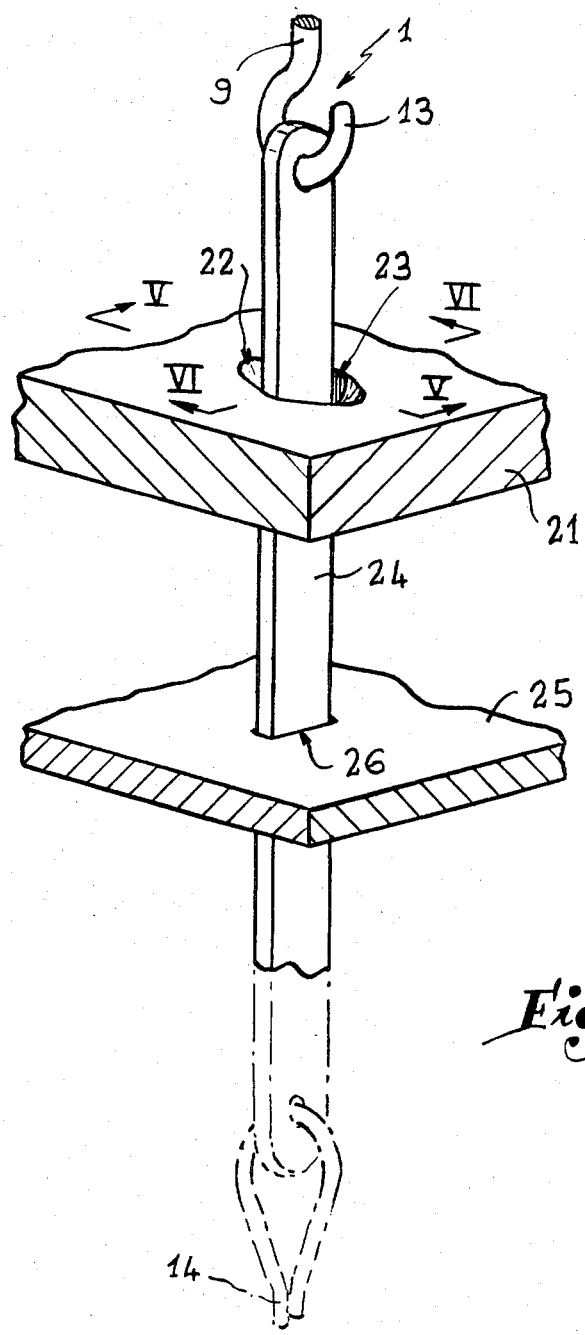
FIG. 4 is a view in perspective, on a larger scale, showing the low part of a hook, the elastic leaf which is attached thereto, as well as the bottom board and the guiding board which it traverses.

In FIGS. 2 and 3, reference 9 designates the shank of a hook. Said shank bears at its upper end a first main nose element 10 (FIG. 2), then slightly lower down, a second main nose element 11, oriented in plan (FIG. 3) at 90° from the preceding one, then much lower down a retaining nose element 12 disposed in plan along the bisectrix of the angle of the preceding nose elements. Finally, the lower end of the shank 9 is curved on itself in the form of an eyelet 13, which is incompletely closed in the embodiment shown, this eyelet being adapted to be connected to the corresponding heddle 14 (FIG. 1) in the manner which will be set forth hereinafter.

The main nose elements 10 and 11 are adapted to cooperate with the blade 15 of the upper gripper frame 16, and the blade 17 of the lower gripper frame 18, respectively, these two frames moving in vertical reciprocating manner in directions opposite to each other. As to the retaining nose element, it cooperates for its part with one of the blades 19 of the fixed open shed frame 20.

As described up to the present, the system incorporating orientable hooks according to the present invention is similar to that described in the Patent mentioned above.

Figure 5:
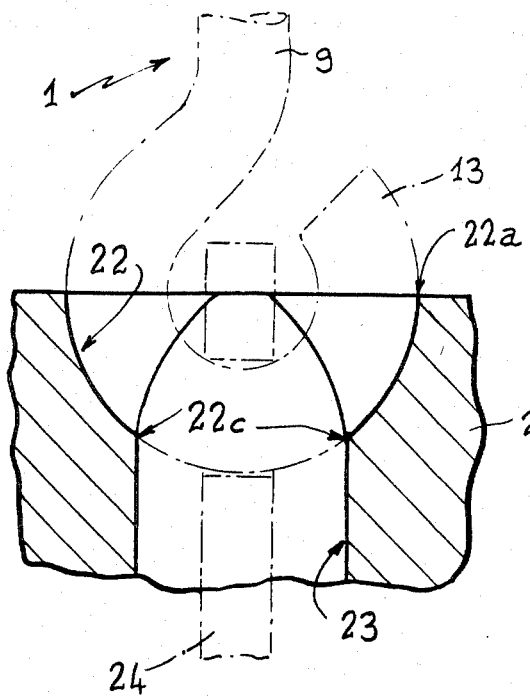
FIGS. 5 and 6 are sections on a still larger scale along V—V and VI—VI.
Figure 6:
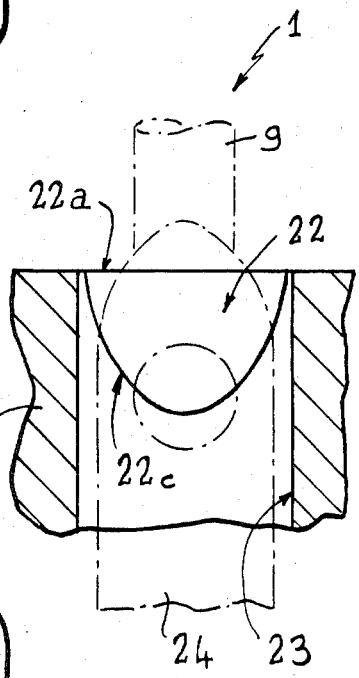
Figure 7:
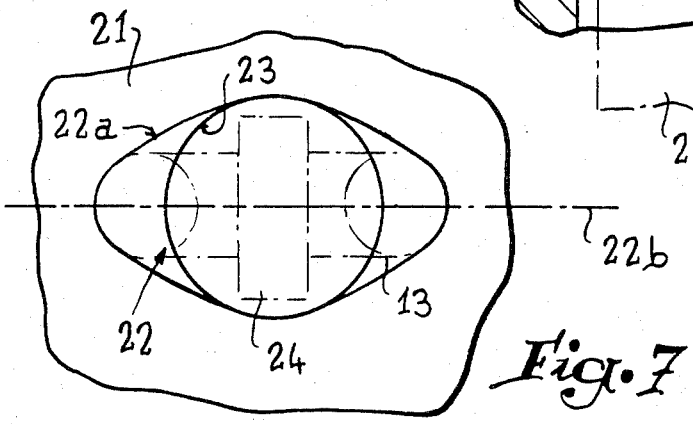
FIG. 7 is a plan view of the depression shown in FIGS. 5 and 6.

However, in that prior system, the non-raised hooks 1 were supported by means of a second fixed frame located beneath the open shed frame 20 and on the blades of which the nose elements 12 came to rest, these blades ensuring their rest orientation indicated in FIG. 3, i.e the retaining nose element 12 in question being located exactly in a vertical plane perpendicular to the blades 15, 17 and 19. Instead of this patented structure, the present invention provides to this end a bottom board 21 hollowed with depressions 22 in which the eyelets 13 are disposed. As shown in FIGS. 4 to 7, each depression 22 presents in plan a flared roughly elliptical inlet portion referenced 22*a* in FIG. 7, this portion comprising a major axis 22*b*. The width of the depression 22 decreases as its lower portion is approached, with the result that, in a vertical plane transverse to the major axis 22*b*, said lower portion is in the shape of a cup, as indicated at 22*c* in FIG. 6. In the vertical plane of the major axis 22*b*, this lower portion is a semi-circumference identical to that of the lower periphery of the eyelet 13, as shown in FIG. 5.

The bottom of the depression 22 is perforated with a circular opening 23 of which the cross section is inscribed inside that 22*a* of the inlet of the depression 22.

Of course, the major axes 22*b* are oriented so that, when an eyelet 13 rests on the bottom of the corresponding depression 22, the retaining nose element 12 of the hook to which this eyelet is fixed is itself oriented as indicated in FIG. 3.

With the eyelet 13 of each hook there is, furthermore, hooked an elastic leaf 24 (FIG. 4) which passes through the opening 22 and at the lower end of which the corresponding heddle 14 is fixed.

Below the bottom board 21, but still above the lower end of the leaves 24 corresponding to hooks in high position, i.e. which have been raised by one of the gripper frames 16, 18, there is provided a guiding board 25 (FIG. 4) pierced with narrow slits 26 for the passage of said leaves 24. The slits 26 are oriented so that, when a hook rests on the bottom of the corresponding depression 22 of the guiding board 21, its leaf 24 provides no torsion.

Operation is as follows:

When a hook 1 is at rest, its lower eyelet 23 rests in the corresponding depression 22 of the bottom board 21 which ensures its exact orientation to within a very small clearance. One is therefore assured that, in a plan view such as that of FIG. 3, the retaining nose element 12 is located in a vertical plane perpendicular to the edges of blades 15, 17, 19.

From this rest position, when the hook 1 in question has been selected, everything occurs as indicated in the above-mentioned patent, the part of the lead 24 located between the guiding board 25 and the eyelet 13 opposing only a very slight reaction of torsion to the rotation through 45° of the shank 9 about its axis in one direction or in the other. Therefore, when one of the main nose elements, 10 for example, has been taken by a gripper frame and is lifted then lowered thereby, the other, 11, is virtually oriented parallel to the blades and does not risk being hooked by one of those of the other frame.

When the hook returns into low position, its lower eyelet 13 engages in the elliptic inlet 22*a* of the depression 22 which ensures centering thereof, so that, even if, by reason of the speed of operation and the passive resistances, the retaining nose element 12 were not perfectly oriented perpendicularly to the blades, this error would be automatically corrected by action of the walls of the depression on the eyelet during penetration of the latter therein.

Furthermore, the elastic leaf 24 exerts on the eyelet 13 a return torque which tends to return the hook precisely to the angular position of FIG. 3 and which torque therefore contributes to ensuring this correct orientation thereof at rest. In addition, this leaf, of which the reaction torque increases rapidly with the torsion angle, opposes any exaggerated rotation of shank 9 which might result in one of the main nose elements being able to encounter a blade intended for another hook (for example the blade located above the shank 9 of FIG. 3).

The invention has therefore provided a system incorporating orientable hooks to be produced, in which the correct orientation of the hooks in low or rest position is ensured with certainty despite the vibrations, effects of inertia and other parasitic actions, which makes it possible for the system to operate at higher speeds than those attained up to the present, without risk of defects in selection occurring.

It must, moreover, be understood that the foregoing description has been given by way of example and that it in no way limits the domain of the invention which would not be exceeded by replacing the details of execution described by any other equivalents. Thus the elastic leaf 24 and the guiding board 25 might possibly be dispensed with, the return of the eyelet 13 and of the shank 9 to the desired angular position being ensured only by the depression 22. It would also be possible to combine the guiding board 25 with the bottom board 21, but, of course, with a shortening of the leaves 24. It will further be noted that the invention would remain applicable even if the system did not comprise an open shed frame 20, the retaining nose elements 12 then being eliminated. Finally, a flat collar without loop might also be used.

We claim:

1. An improved hook mechanism for a double-lift open shed Jacquard machine of the type having upper and lower frames reciprocating vertically in opposition to one-another, the frames respectively having gripper blades for engaging vertically spaced nose elements on shanks of the hooks for displacing the hooks to raised positions, said nose elements on each hook being angularly displaced about the shank at right angles to eachother and at 45° with respect to the blades when the hooks are angularly oriented in their rest positions, and the shanks being oppositely rotated 45° from their rest positions when engaged by blades on the respective upper and lower frames, and the machine having Jacquard needles extending across the hooks and respectively operative to displace the hooks laterally to select engagements by the blades with the nose elements to control the weaving pattern, the hooks normally contacting in their rest positions a bottom board having perforations providing access to the heddles therebelow, the improvements wherein:

(a) each shank has a bottom end formed to provide an eyelet which is wider than the thickness of the shank in the plane of the eyelet, and the eyelet overlying a perforation of the bottom board and being coupled to a heddle; and wherein (b) the bottom board is shaped at each perforation to provide a flared inlet portion comprising a roughly elliptical depression which is shaped to receive the bottom end of an eyelet and operative to rotate it toward its rest-position angular orientation; and wherein (c) the inlet portion leads into a lower portion shaped to receive and closely fit the bottom end of an eyelet to retain it in precise angular orientation when in said rest position.

2. The hook mechanism as claimed in claim 1, further comprising a fixed guiding board spaced below said bottom board and disposed between it and the heddles, the guiding board having slits aligned with the perforations of the bottom board; an elongated elastic leaf passing through each aligned slit and the associated perforation and coupling an eyelet with a heddle, the slits being oriented with respect to the plane of the associated eyelet such that the leaf provides no rotational torque on the hook when in its rest-position angular orientation and provides a torque on the eyelet tending to return it to its rest-position orientation when displaced therefrom.

3. An improved hook mechanism for a double-lift open shed Jacquard machine of the type having upper and lower frames reciprocating vertically in opposition to one-another, the frames respectively having gripper blades for engaging vertically spaced nose elements on shanks of the hooks for displacing the hooks to raised positions, said nose elements on each hook being angularly displaced about the shank at right angles to each other and at 45° with respect to the blades when the hooks are angularly oriented in their rest positions, and the shanks being oppositely rotated 45° from their rest positions when engaged by blades on the respective upper and lower frames, and the machine having Jacquard needles extending across the hooks and respectively operative to displace the hooks laterally to select engagements by the blades with the nose elements to control the weaving pattern, the hooks having bottom ends stopping in their rest positions at a bottom board having perforations providing access to the heddles therebelow, the improvements wherein:

(a) the bottom end of each shank is formed with a flat eyelet;

(b) a fixed guiding board spaced below said bottom board and disposed between it and the heddles, the guiding board having slits aligned with the perforations of the bottom board;

(c) an elongated elastic leaf passing through each aligned slit and the associated perforation and coupling an eyelet with a heddle; and (d) the slits being oriented with respect to the plane of the associated eyelet such that the leaf provides no rotational torque on the hook when in said rest-position angular orientation and provides a torque on the eyelet tending to return it to its rest-position orientation when displaced therefrom.

* * * * *